US005421162A

United States Patent [19]

Gustafson et al.

[11] Patent Number: 5,421,162

[45] Date of Patent: Jun. 6, 1995

[54] LNG DELIVERY SYSTEM

[75] Inventors: Keith Gustafson, Waleska, Ga.; Duane Preston, New Prague, Minn.

[73] Assignee: Minnesota Valley Engineering, Inc., New Prague, Minn.

[21] Appl. No.: 200,167

[22] Filed: Feb. 23, 1994

[51] Int. Cl.[6] ..... F25B 19/00

[52] U.S. Cl. ..... 62/7; 62/50.1; 123/525; 123/527

[58] Field of Search ..... 62/50.2, 50.1, 47.1, 62/7; 123/525, 527

[56] References Cited

U.S. PATENT DOCUMENTS

| | | | |
|---|---|---|---|
| 2,487,863 | 11/1949 | Garretson | 62/50.1 |
| 2,956,412 | 1/1959 | Loebeck . | |
| 3,710,584 | 1/1973 | Leonard . | |
| 5,127,230 | 7/1992 | Neeser et al. . | |
| 5,163,409 | 11/1992 | Gusfatson et al. . | |

OTHER PUBLICATIONS

Abstract; "LNG–The Sensible Alternative For Medium To Heavy Duty Vehicles"; by George W. Kalet; Oct., 1991.

*Primary Examiner*—Ronald C. Capossela
*Attorney, Agent, or Firm*—Rockey, Rifkin and Ryther

[57] ABSTRACT

Liquid natural gas is pumped into a main tank until the main tank is completely filled with liquid. Once filled, high pressure gas is pumped into the main tank. This high pressure gas forces the liquid from the main tank into an overflow tank until the liquid level in the main tank reaches a predetermined level. High pressure gas is then pumped through the main tank to the overflow tank until the LNG in the overflow tank is saturated at a pressure slightly higher than the pressure needed at the use device. Once the desired pressure is achieved the delivery of LNG to the delivery system is stopped. LNG is initially delivered from the overflow tank to the use device as a high pressure gas. Some of the high pressure gas being delivered from the overflow tank is diverted from the use device to saturate the LNG in the main tank at the desired pressure. The LNG will be delivered from the overflow tank is depleted and then the LNG will be delivered from the main tank which will have been saturated by the high pressure gas from the main tank.

24 Claims, 5 Drawing Sheets

LNG DELIVERY SYSTEM

BACKGROUND OF THE INVENTION

This invention relates, generally, to liquid natural gas (LNG) delivery systems and, more specifically, to a high pressure LNG delivery system particularly suited for use on natural gas powered motor vehicles.

In order to avoid dependence on foreign sources of fuel oil, great efforts have been made to find a cheap and reliable domestic energy alternative. One such alternative is natural gas (NG) which is domestically available, plentiful and relatively inexpensive and environmentally safe as compared to oil. Because one of the largest uses for oil is as a fuel for motor vehicles, great efforts have been made to develop natural gas powered engines.

Some proposed engines require that the intake pressure of the NG be at elevated pressures, i.e. 300 psig or the like. This presents a particular problem when one wishes to utilize LNG as the vehicle fuel because LNG is preferably stored at the range of 15 to 50 psig where it is very dense.

One such engine is a dual-fuel modified diesel engine which runs on a 60/40 LNG to diesel fuel mixture. While this engine substantially reduces diesel fuel consumption, it requires that LNG be delivered to the engine at approximately 300 psi, a pressure approximately 6 times the normal storage pressure for LNG. This extremely high pressure causes storage and handling problems for the volatile LNG. These problems are magnified by the fact that when the LNG is carried on a motor vehicle, it is exposed to relatively high temperatures and constant motion. Of particular concern is the difficulty in pressurizing the LNG because the constant motion of the vehicle causes the LNG to mix with the natural gas vapor pressure head thereby condensing the natural gas vapor and collapsing the pressure head. This causes all the stored LNG to heat up to an equilibrium temperature—near that of 300 psig—whereby it increases in volume to a point where it could "liquid over fill" the tank.

To compensate, the tank capacity at time of fill cannot be fully utilized, thus undesirably limiting the range of the vehicle. Also for a tank to hold 300 psig it must have a reserve pressure (to accept pressure rise when fueled, but not in use) and a 500 psig rating would be considered normal. Pressure tanks which safely contain 500 psig require much thicker and heavier walls than those which contain 50 psig, and this additional weight reduces the net payload of the vehicle, also an undesirable condition.

Another proposed method of providing 300 psig intake pressure from LNG stored at 15 psig is to provide a pump, whose intake pressure is storage pressure (15–50 psig) and discharge pressure is 300 psig or the like. However, pumps that dependably supply liquid at a rate proportionate to their speed—a desirable function when supplying fuel to an engine where fuel supply determines the vehicle speed—require a Net Positive Suction Head (NPSH). At standard cryogenic pump installations, various methods are utilized to obtain NPSH, but most involve stratification and/or hydrostatic head (i.e. sub-cooling) in the pump supply tank. However, tanks containing cryogens (i.e. LNG) tend to quickly destratify and come to equilibrium throughout when vibrated, as would normally occur when a bus or truck is in motion. Such being the case, a vehicle pump can experience varying NPSH (in fact, as low as 0), thus varying volumetric efficiencies—ranging from no flow to high flow. To a vehicle operator this would produce difficult to control engine/vehicle speed variations, a potentially unsafe condition.

Adding a post-pump reservoir and substitute regulator control to smooth out these variations has also been suggested. However, such a reservoir represents high pressure compressed natural gas ("CNG") and constitutes considerable additional equipment. In addition, such a system has difficulty dealing with the boil-off gaseous NG from its stored LNG.

SUMMARY OF THE INVENTION

The LNG delivery system of the invention overcomes the above-noted shortcomings of the prior art and consists of main and overflow vehicle mounted tanks connected in series. Liquid natural gas is pumped into the first or main tank until the main tank is completely filled with liquid. Once filled, high pressure gas is pumped into the main tank. This high pressure gas forces the liquid from the main tank into the second or overflow tank until the liquid level in the main tank falls to a predetermined level. High pressure gas is then pumped through the main tank to the overflow tank until the LNG in the overflow tank is saturated at a pressure slightly higher than the pressure needed at the use device. Once the desired pressure is achieved the delivery of LNG to the delivery system is stopped.

LNG is initially delivered from the overflow tank to the use device as a high pressure gas. Some of the high pressure gas being delivered from the overflow tank is diverted from the use device to saturate the LNG in the main tank at the desired pressure. The LNG will be delivered from the overflow tank until it is depleted and then the LNG will be delivered from the main tank which will have been saturated by the high pressure gas from the main tank. This system delivers high pressure LNG to the use device without all of the LNG in the entire system being saturated during the fill operation. As a result, the hold time of the system increases to three times that of a high pressure delivery system where the entire system is saturated at fill.

DETAILED DESCRIPTION OF THE INVENTION

Figure 1:
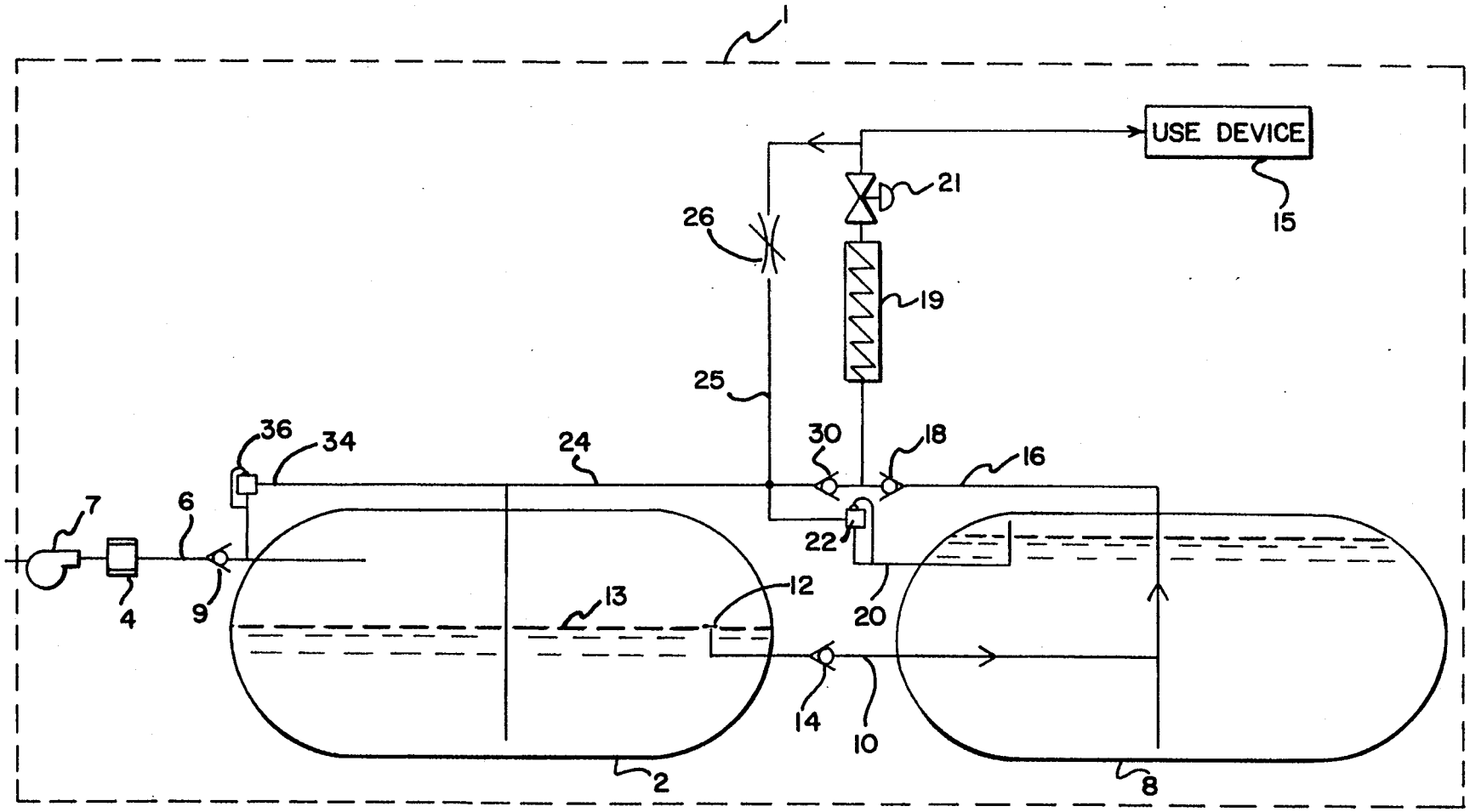
FIG. 1 is a schematic view of the fluid delivery system of the invention.

Referring more particularly to FIG. 1, a vehicle 1 having the delivery system of the invention where the delivery system of the invention consists of a main tank 2 connected to a releasable connector 4 by fill line 6. Connector 4 can be releasably connected to a source of LNG and high pressure NG vapor 7. A check valve 9 ensures that NG can flow only in the direction from source 7 to tank 2. While only a single main tank 2 is illustrated, it is to be understood that additional tanks connected in series with tank 2 could be used to expand the capacity of the system. The additional tanks would be filled from tank 2 during the initial fill operation of the system.

Tank 2 is connected to an overflow tank 8 via fill line 10. Fill line 10 terminates in a trycock 12 that is located in tank 2 at the desired level of liquid fill 13 as will hereinafter be described. A check valve 14 is also located in line 10 allowing flow of fluid only in the direction from tank 2 to tank 8.

A primary LNG delivery line 16 connects tank 8 to the use device to deliver LNG at high pressure. In the illustrated embodiment primary delivery line 16 is connected to fill line 10 although a separate line can be used. Primary delivery line 16 includes check valve 18 which allows the flow of product only in the direction from the tank 8 to the use device. Line 16 further includes a heat exchanger 19 for vaporizing the LNG before it is delivered to the use device. Finally, a valve 21 is located in line 16 to control the flow of NG to the use device. Valve 21 is, for example, a shut off valve that opens and closes with the actuation of the ignition switch of a vehicle.

An economizer circuit 20 connects tank 8 to tank 2 via line 24 and includes an economizer regulator 22. Economizer regulator 22 allows high pressure vapor in tank 8 to flow into tank 2 automatically should the pressure in tank 8 rise above the predetermined pressure set at regulator 22. The use of the economizer circuit 20 eliminates the need to vent gas from tank 8 when the pressure in the tank rises. As a result, product is not wasted and the high pressure gas from tank 8 is used to elevate the temperature and pressure of the NG in tank 2. Moreover, for cryogen gases such as NG the elimination of venting is an important safety consideration.

Pressurizing line 25 connects delivery line 16 to line 24 which is connected to tank 2 as previously described. Line 25 includes a restricted orifice/check valve 26 that allows a portion of the gas being delivered to the use device via line 16 to be diverted to tank 2 but prevents the flow of fluid in the opposite direction. The gas diverted from line 16 and delivered to tank 2 will pressurize and heat the LNG in tank 1 to thereby saturate it at a pressure slightly higher than the pressure required at the use device. Because the volume of LNG in tank 2 after filling is known as determined by the placement of trycock 12, the amount of warm gas necessary to saturate the LNG can be determined and the amount of gas delivered to tank 2 can be selected accordingly. The amount of warm gas delivered to tank 2 is selected to provide complete saturation of the LNG in tank 2 before the supply of LNG in tank 8 is depleted.

A check valve 30 is provided in line 24 to allow LNG to flow from tank 2 to delivery line 16 only when the pressure in tank 2 is greater than the back pressure on check valve 30 created by the pressure in tank 8 such that tank 8 will empty first.

To accommodate pressure rises in tank 2, an economizer circuit 34 is connected to line 24. While in the illustrated embodiment circuit 34 taps into fill line 6, separate lines could be used. Economizer circuit includes a regulator 36 that will allow NG vapor to flow from tank 2 to line 24 when the pressure in tank 2 rises above a predetermined value. Check valve 30 will allow the vapor to be delivered to the use device if the pressure in tank 2 rises above the back pressure on check valve 30 created by the pressure in tank 8.

The operation of the delivery system of the invention will now be described. To fill the system, a source of LNG is connected to the system at connector 4 and LNG is pumped into tank 2 until the tank is completely filled. The LNG will not flow into tank 8 because check valve 14 will not open at the low pressure at which the LNG is being delivered.

Once tank 2 is filled with LNG, NG vapor will be pumped into the tank under high pressure. As a result, the LNG in tank 2 will be forced past valve 14 and into tank 8. This will continue until the level of LNG in tank 2 reaches level 13 as determined by trycock 12 at which time NG vapor will pass through line 10 and into tank 8. The incoming vapor will bubble up through the LNG to increase the pressure and temperature in tank 8 until the LNG is saturated at a pressure slightly higher than the pressure needed at the use device. At this time the system is filled and the source of LNG and natural gas vapor is disconnected from connector 4. In this state the LNG in tank 8 is saturated at a higher pressure while the LNG in tank 2 is not. The continued contact between the cold LNG and the vapor in the tank 2 will maintain a relatively low pressure in tank 2. As a result, the hold time in the system is 2 to 3 times longer than it would if the entire system was saturated at a higher pressure.

In normal operation, when a demand for LNG is created at valve 21, LNG will be delivered to the use device such as engine 15 from tank 8 via line 16. Concurrently, a portion of the NG vapor delivered through line 16 will be diverted to tank 2 through lines 25 and 24. Thus, as LNG is delivered to the use device from tank 8, tank 2 is gradually brought to the desired saturation pressure and temperature.

Should the pressure in tank 8 rise above a predetermined level, for example, as a result of the vehicle sitting at rest for an extended period of time, the economizer circuit 20 will allow the high pressure NG vapor in tank 8 to be vented to tank 2 via line 24. This venting of the high pressure gas from tank 8 to tank 2 increases the hold time of the system because the cold liquid in tank 2 absorbs the gas from tank 8.

When tank 8 is empty, tank 2 will be saturated and delivery of high pressure LNG is made from tank 2 via lines 24 and 16. Should the pressure in tank 2 rise above the predetermined value set at regulator 36, high pressure NG will be delivered from tank 2 to the use device via economizer circuit 34 thereby to relieve the pressure in the tank. Once tank 2 is depleted, the system can be refilled as previously described.

Figure 2:
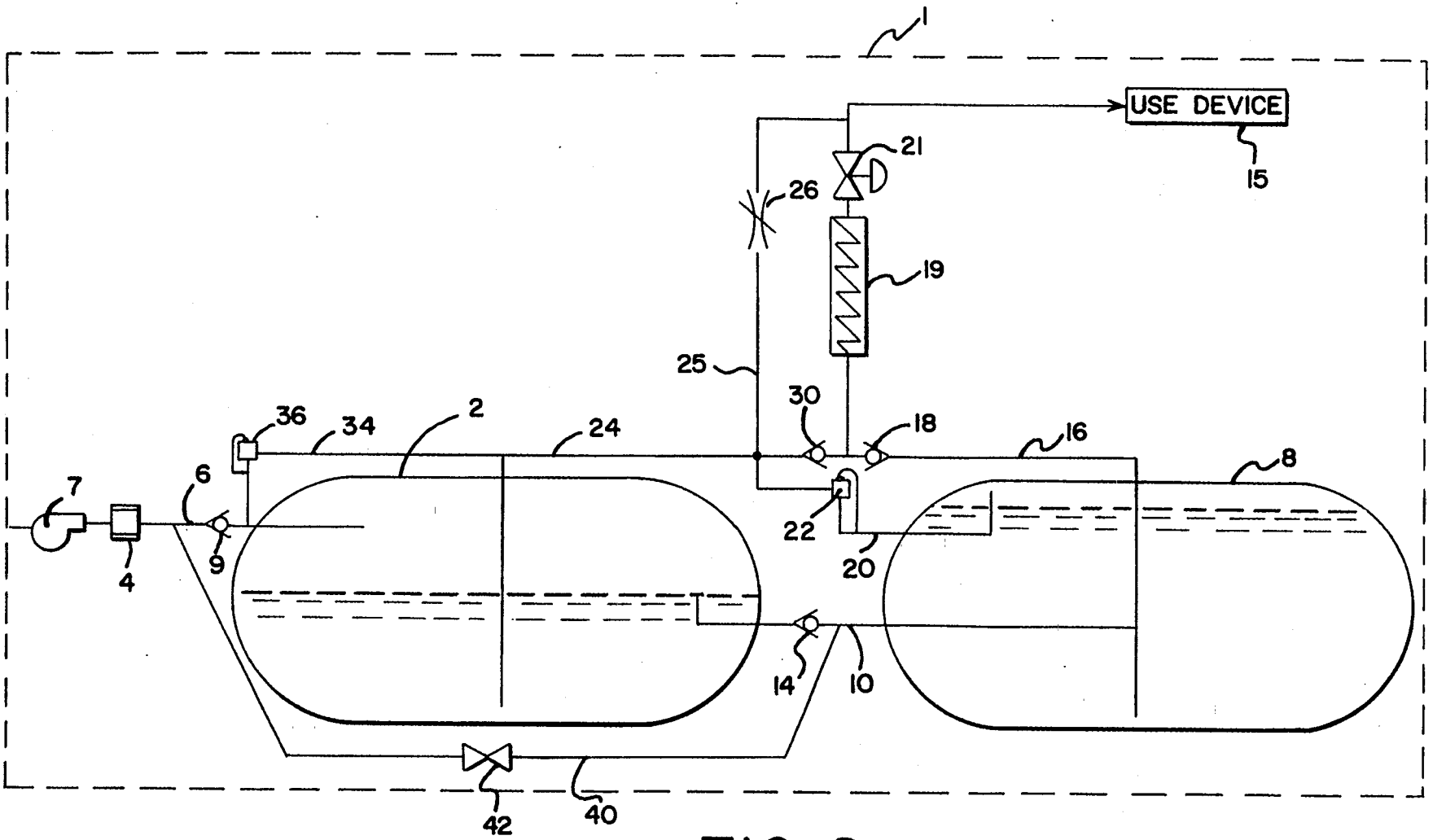
FIGS. 2 and 3 are modifications of the delivery system of the invention.

Referring more particularly to FIG. 2, a modification of the preferred embodiment is illustrated. The system of FIG. 2 is identical to that of FIG. 1 except that a separate LNG vapor delivery line 40 is provided between fill line 6 and fill line 10. A valve 42 is located in line 40 to selectively open and close the line. When the system is being filled from the external source of LNG 7, valve 42 will be closed preventing flow of LNG through line 40 and allowing tank 2 to be filled with LNG. However, when the high pressure NG vapor is pumped into tank 2, as previously described, valve 42 will be opened to allow a portion of the gas to bypass tank 2 and be delivered directly to tank 8. The result of this delivery is that the NG vapor delivered to tank 8 will be warmer than that delivered in the embodiment shown in FIG. 1 because the NG vapor will not have to contact the relatively colder LNG in tank 2. As a result, the LNG in tank 8 will be saturated more quickly to shorten the fill operation. Once the LNG in tank 8 is saturated the vehicle can be driven away.

Figure 3:
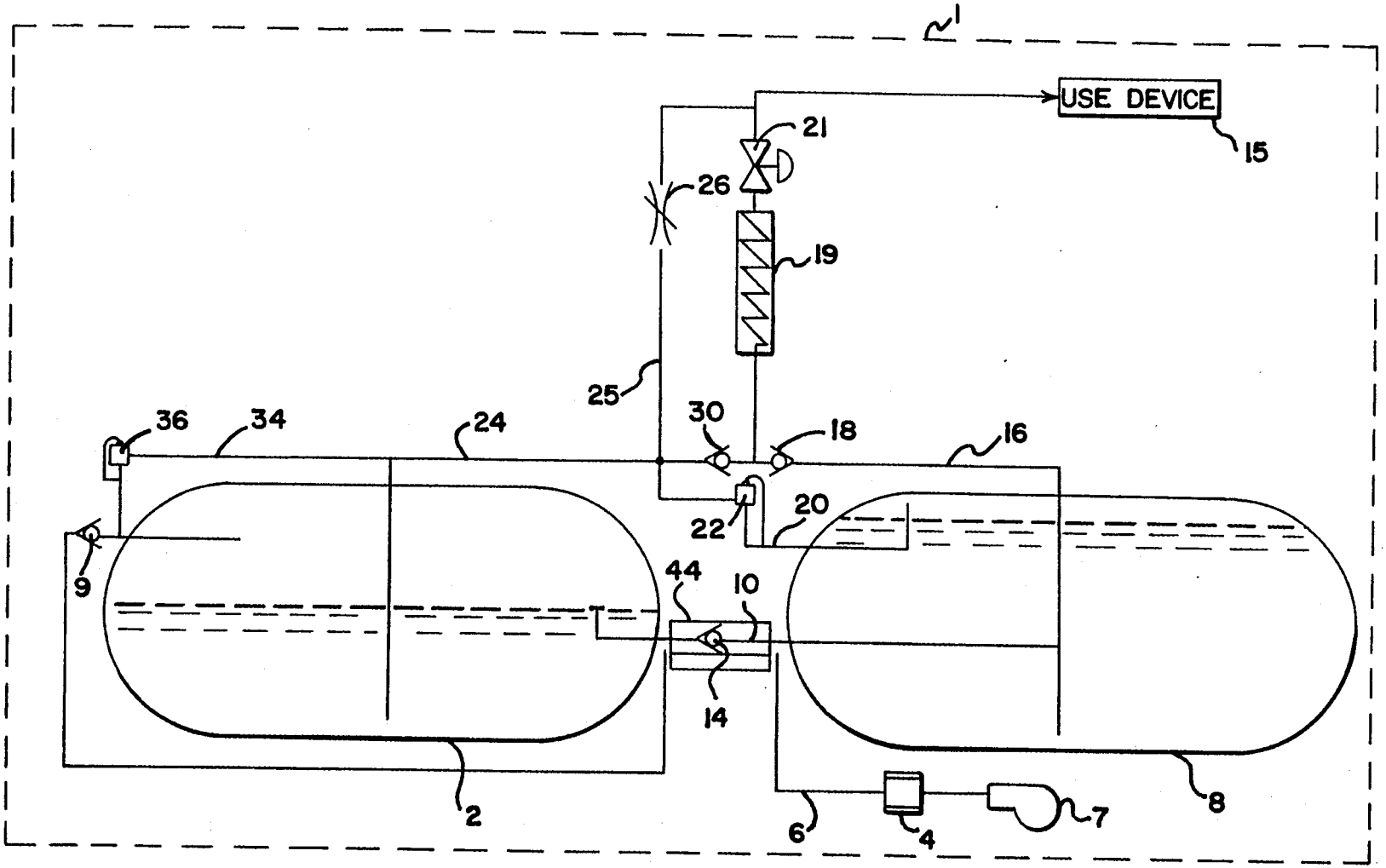

Another embodiment of the invention is shown in FIG. 3. The embodiment of FIG. 3 is identical to that of FIG. 1 except that fill lines 6 and 10 are passed through a common heat exchanger 44. As a result, when NG vapor is delivered to this system from the external source 7, it will heat the LNG and NG vapor being delivered through line 10 from tank 2 to tank 8. As a result, the LNG in tank 8 will be saturated more quickly.

Figure 4:
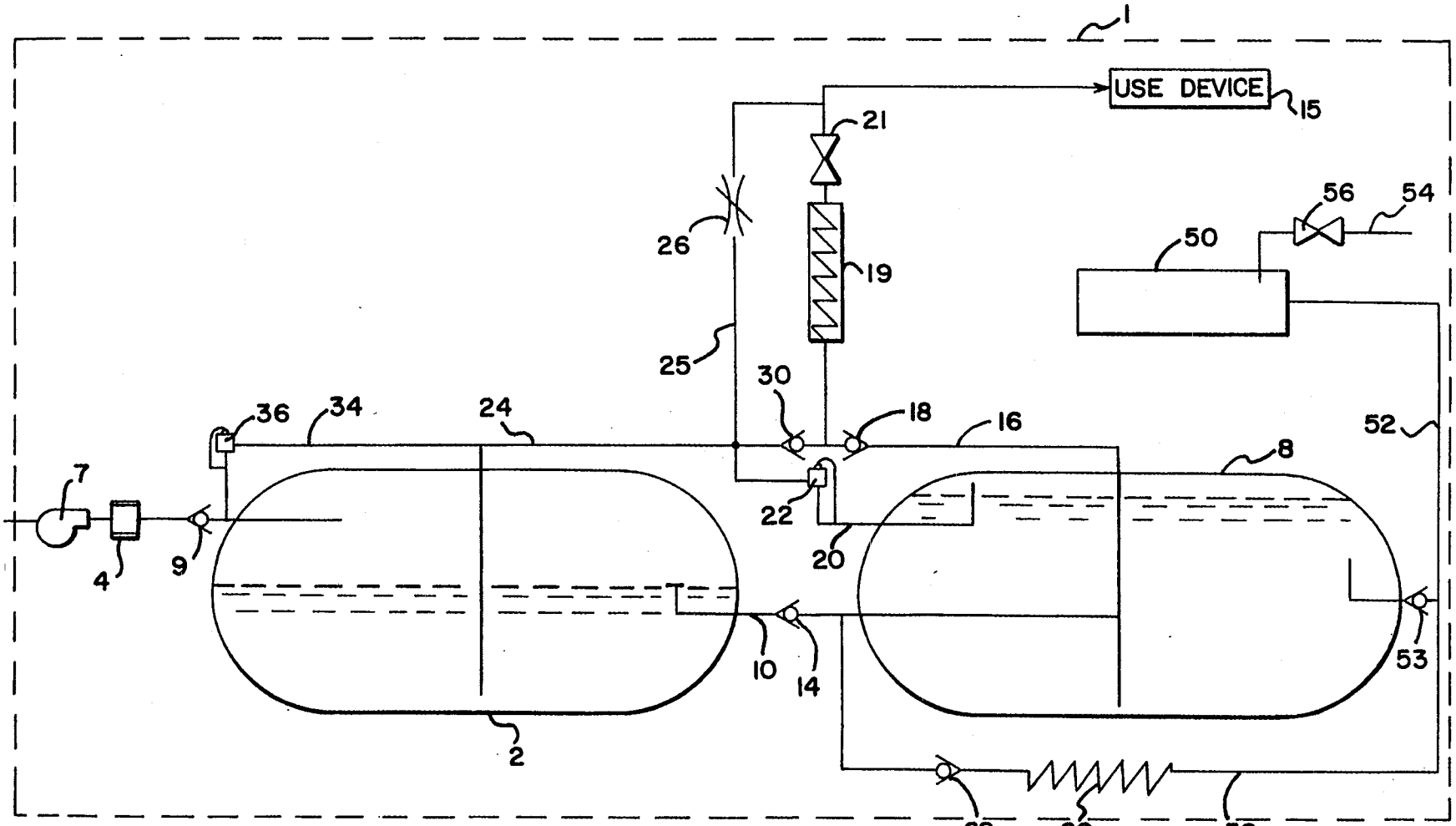
FIG. 4 is a schematic view of a gravity fill vent system according to the invention.

A further embodiment of the invention is shown in FIG. 4. The embodiment of FIG. 4 is used for systems that require a vent fill rather than the no vent fill of the preferred embodiments. In vent fill systems, NG vapor is vented from the system to accommodate the incoming LNG. Because vent fill systems are open systems, the system cannot be pressurized as are the no vent systems previously described.

Accordingly, the vent fill system includes an additional tank 50 connected in series with tank 8 via fill line 52. Line 52 includes check valve 53 that allows fluid to flow only in the direction from tank 8 to tank 50. Tank 50 is uninsulated such that any LNG therein will be vaporized. Tank 50 vents to the atmosphere via vent line 54 which is provided with a valve 56 to open or close the line. A pressurization line 58 is provided between line 52 and fill line 10 and includes vaporizer 60 and check valve 62. Note that line 58 is connected to fill line 10 downstream of check valve 12 such that any LNG in line 58 will flow only into tank 8.

In operation, tank 2 is filled with LNG as previously described. When high pressure NG vapor is pumped into tank 2, LNG will be forced into both tank 8 and tank 50. During this process NG will be vented from open line 54 to accommodate the incoming NG. Once tanks 2, 8 and 50 are filled to the desired levels with LNG, valve 56 is closed. Because tank 50 is uninsulated, the LNG stored therein will heat, vaporize and expand causing a large build up of pressure. The NG vapor and LNG will be forced from tank 50, through lines 52, 58 and 10 and into tank 8. Vaporizer 60 is provided to further heat and expand the NG vapor. The NG vapor delivered to tank 8 will saturate the LNG therein at or slightly higher than the pressure required by the use device. Thus, the uninsulated chamber 50 acts like the pump in the preferred embodiment to force hot NG vapor under pressure into tank 8. Once tank 8 is saturated the delivery system of the invention operates in the same manner as described with respect to the embodiment of FIG. 1.

Figure 5:
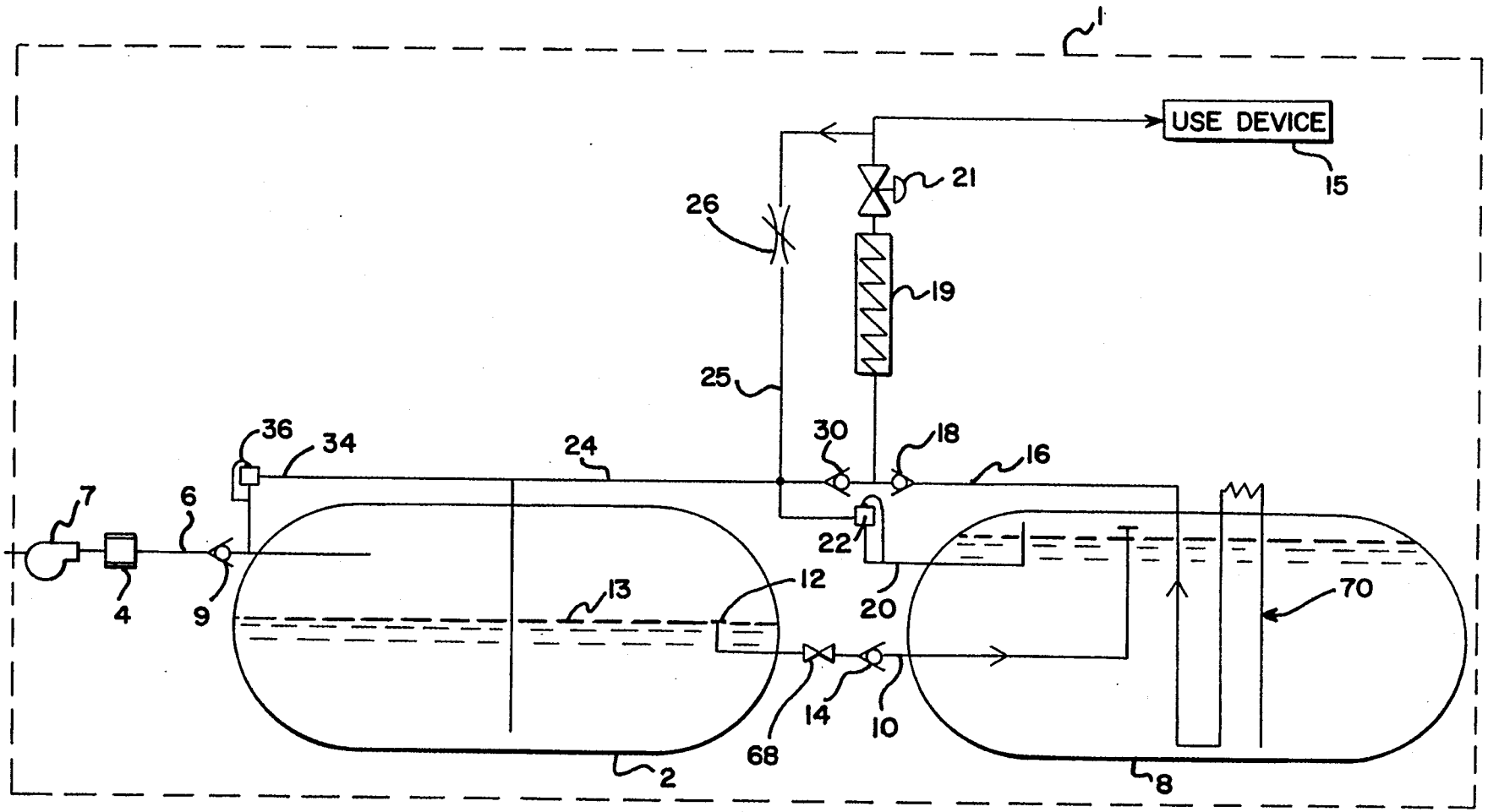
FIG. 5 is a schematic view of another embodiment of the invention.

Referring more particularly to FIG. 5, a further embodiment of the invention is illustrated that is similar to the embodiment of FIG. 1 except that a pneumatic shut off valve 68 is located in line 10 upstream of check valve 14. Valve 68 is operated by the fill system and remains closed until the fill system pressurizes the LNG initially delivered to tank 2 to approximately 400 psi during the pressurization phase of the fill operation. Once the pressure in tank 2 reaches the desired value, valve 68 is opened and the LNG is forced from tank 2 to tank 8 by the pressure in tank 2.

High pressure gas is continued to be delivered from the fill station through tank 2 and into tank 8 until the pressure in tank 8 reaches the final desired pressure. Unlike the embodiment of FIG. 1, the gas is delivered into tank 8 from above the LNG via line 10, rather than bubbling up through the LNG. As a result, heat transfer is not as efficient and temperature stratification will occur in the LNG. Because of the stratification, the final pressure in tank 8 after delivery will be higher than the saturation pressure. For example, the delivery of gas to tank 8 will be halted when the pressure in the tank reaches 375 psi to achieve a saturation pressure of 325 psi.

To deliver LNG from tank 8 pressure building loop 70 is used in line 16. Loop 70 draws LNG from tank 8, takes it outside of tank 8 where it is heated and passes it back through the LNG in tank 8 before it is delivered to the use device. This loop causes the pressure in tank 8 to be continuously built to the level of the setting of economizer 22 and insures that tank 8 will be emptied of product before LNG is supplied from tank 2.

While the invention has been described in some detail with respect to the figures, it will be appreciated that numerous changes in the details and construction of the system can be made without departing from the spirit and scope of the invention as set forth in the appended claims.

What is claimed is:

1. A system for the storage and delivery of LNG to a use device comprising:
   (a) main storage means (8) for storing a quantity of LNG saturated at a pressure equal to or slightly higher than the pressure required at the use device;
   (b) overflow storage means (2) for storing a quantity of non-saturated LNG;
   (c) means for delivering natural gas (NG) to the use device first from said main storage means (8) and then from said overflow storage means (2); and
   (d) means for saturating the LNG in the overflow storage means (2) while delivering LNG from said main storage means (8).

2. The system according to claim 1, further including means for filling the main and overflow storage means with known quantities of LNG.

3. The system according to claim 2, wherein said means for filling includes a main fill line connected between a source of LNG and said overflow storage means, an overflow fill line connected between said main and overflow storage means and a means for preventing the flow of LNG between the main and overflow storage means until the pressure in the overflow storage means reaches a predetermined value.

4. The system according to claim 1, wherein said means for saturating includes means for transferring high pressure NG vapor to said overflow storage means from said main storage means.

5. The system according to claim 4, wherein the means for transferring includes means for diverting high pressure NG vapor from the NG vapor being delivered to the use device from the main storage means.

6. The system according to claim 1, further including means for delivering high pressure NG vapor to said main storage means.

7. The system according to claim 6, wherein the means for delivering high pressure NG vapor bubbles the vapor through the LNG in the main storage means.

8. The system according to claim 6, wherein the means for delivering high pressure NG vapor delivers the NG vapor over the LNG in the main storage means.

9. The system according to claim 6, wherein said means for delivering high pressure NG vapor includes an uninsulated chamber connected to said main storage means.

10. The system according to claim 1, further including means for removing LNG vapor from said main storage means if the pressure in the main storage means rises above a predetermined value and for delivering the NG vapor to the overflow storage means.

11. The system according to claim 1, wherein said delivery system is mounted on a vehicle.

12. The system according to claim 1, further including means for transferring heat from the LNG being delivered to the use device to the LNG in the main storage means.

13. A vehicle mounted LNG storage and delivery system for delivering high pressure LNG to the vehicle's engine comprising:

(a) main means (8) and overflow means (2) for storing LNG;

(b) means for delivering LNG from the main and overflow means to the use device;

(c) third means for saturating the LNG in the main means (8) at a pressure at or above that required by the engine before delivering LNG therefrom; and (d) fourth means for saturating the LNG in the overflow means (2) at a pressure at or above that required by the use device while LNG is being delivered from the main means.

14. The system according to claim 13, further including means for filling the main and overflow means with known quantities of LNG.

15. The system according to claim 14, further including means for filling said main and overflow means including a main fill line connected between a source of LNG and said overflow means, an overflow fill line connected between said main and overflow means and a means for preventing the flow of LNG between the main and overflow means until the pressure in the main means reaches a predetermined value.

16. The system according to claim 13, wherein said third means for saturating includes means for delivering high pressure NG vapor to said main means.

17. The system according to claim 16, wherein said means for delivering high pressure NG vapor includes a pump external to said system.

18. The system according to claim 16, wherein said means for delivering high pressure NG vapor includes an uninsulated chamber connected to said main means.

19. The system according to claim 13, wherein the fourth means for saturating the LNG in the overflow means includes means for transferring high pressure gas from said main means to said overflow means.

20. The system according to claim 19, wherein the means for transferring includes means for diverting high pressure NG vapor from the NG vapor being delivered to the engine from the main means.

21. The system according to claim 13, further including means for removing NG vapor from said main means if the pressure in the main means rises above a predetermined value and for delivering the NG vapor to the overflow means.

22. A method for storing and delivering LNG to a vehicle engine comprising the steps of:

(a) providing main and overflow tanks mounted on said vehicle;

(b) filling the main tank to capacity with LNG;

(c) displacing LNG from the main tank to the overflow tank with natural gas under high pressure until the level of LNG in the main tank reaches a predetermined level;

(d) continuing to deliver high pressure natural gas to said overflow tank until the LNG therein is saturated at a pressure at or above that required by the vehicle engine;

(e) delivering LNG from the overflow tank to the engine and delivering high pressure natural gas from the overflow tank to the main tank until the LNG in the main tank is saturated at a pressure at or above that required by the vehicle engine; and (f) delivering LNG from the main tank to the vehicle engine after the LNG in the overflow tank is depleted.

23. A method according to claim 22, further including the step of automatically delivering NG from the overflow tank to the main tank when the pressure in the overflow tank rises above a predetermined value.

24. A method according to claim 22, further including the steps of providing a third tank for receiving and vaporizing a quantity of LNG and delivering of the high pressure NG vapor from the third to the overflow tank to saturate the LNG in the overflow tank.

* * * * *